US006647647B2

(12) United States Patent
Auger et al.

(10) Patent No.: US 6,647,647 B2
(45) Date of Patent: Nov. 18, 2003

(54) ARTICLE OF FOOTWEAR WITH A GROUND-ENGAGING MEMBER AND METHOD OF ALTERING A GROUND-ENGAGING MEMBER

(75) Inventors: Perry Auger, Tigard, OR (US); Kevin Fallon, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/988,736

(22) Filed: Nov. 20, 2001

(65) Prior Publication Data

US 2003/0093925 A1 May 22, 2003

(51) Int. Cl.[7] ..... A43B 5/02
(52) U.S. Cl. ..... 36/134; 36/61
(58) Field of Search ..... 36/134, 67 D, 36/61, 128

(56) References Cited

U.S. PATENT DOCUMENTS

| | | | | | |
|---|---|---|---|---|---|
| 19,205 | A | * | 1/1858 | Pollard | 36/61 |
| 691,857 | A | * | 1/1902 | Hansen | 36/41 |
| 1,361,078 | A | * | 12/1920 | Lynn | 36/61 |
| 1,662,111 | A | * | 3/1928 | Halstead | 36/61 |
| 2,002,556 | A | * | 5/1935 | Tubbs | 36/59 R |
| 2,934,840 | A | * | 5/1960 | Mistarz | 36/34 R |

(List continued on next page.)

FOREIGN PATENT DOCUMENTS

| | | | |
|---|---|---|---|
| EP | 0783845 | | 7/1997 |
| EP | 0815759 | | 1/1998 |
| FR | 2567004 | * | 7/1984 |
| GB | 2341308 | | 3/2000 |
| WO | 0178544 | | 10/2001 |

OTHER PUBLICATIONS

Fogdog Sports, webpage, Fogdog Products Guide—Making the Right Choices—Expert Advise How to Buy Soccer Cleats, 7 sheets, Oct. 2000.

Fogdog Sports, webpage, Soccer, Stadio Elite Replaceable by Lotto, 3 sheets, Oct. 2000.

Fogdog Sports, webpage, Soccer, Volante Pro Replaceable Cleats by Puma, 2 sheets, Oct. 2000.

Fogdog Sports, webpage, Soccer, Scudetto SC by Diadora, 2 sheets, Oct. 2000.

Fogdog Sports, webpage, Soccer, King Replaceable by Puma, 2 sheets, Oct. 2000.

Fogdog Sports, webpage, Soccer, Tiempo Premier SG by Nike, 2 sheets, Oct. 2000.

Fogdog Sports, webpage, Soccer, Goldline Screw in by Patrick, 2 sheets, Oct. 2000.

MacNeill Engineering Worldwide, webpage, Spke Fastening Systems, 2 sheets, (date unknown, but prior to filing of this application).

Champ Accessories, Champs Is An Accessory To Your Golf Sales, 1 sheet, (date unknown, but prior to filing of this application).

Champ, Adverstisement, Champ Q–Lok System (date unknown, but prior to the filing date of this application).

*Primary Examiner*—Ted Kavanaugh
(74) *Attorney, Agent, or Firm*—Banner & Witcoff, Ltd.

(57) ABSTRACT

An article of footwear provided with a ground engaging unit. The ground-engaging unit according to the present invention extends outwardly from a sole of the article of footwear, and has at least a portion that can be adjusted to present a varying height profile (i.e., a distance that the ground-engaging unit extends from the sole). The ground-engaging unit is preferably a single unit attached or otherwise fixed to the sole. It preferably includes a tip movably mounted on a base. The tip is selectively extendible or retractable with respect to the base. In one embodiment of the present invention, the tip and the base are threadedly engaged, such that the height of the tip is adjustable by rotating the tip relative to the base between predetermined positions. A locking mechanism may also be provided to fix the tip and base in a particular relative relationship.

29 Claims, 5 Drawing Sheets

U.S. PATENT DOCUMENTS 3,267,593 A 8/1966 Turner
3,442,033 A 5/1969 Hillburn, Jr.
3,526,976 A 9/1970 Jacobs
3,566,489 A 3/1971 Morley
3,715,817 A 2/1973 White et al.
3,738,026 A 6/1973 Granger
3,805,418 A * 4/1974 Matuka et al. ..... 36/34 A
3,898,751 A * 8/1975 Gustin ..... 36/67 D
3,911,600 A * 10/1975 Dassler ..... 36/67 D
4,306,360 A 12/1981 Hagger
4,318,232 A * 3/1982 Ching ..... 36/73
4,523,396 A * 6/1985 Dassler ..... 36/134
4,633,600 A * 1/1987 Dassler et al. ..... 36/134
5,123,184 A 6/1992 Ferreira
5,321,901 A 6/1994 Kelly
5,361,518 A 11/1994 Sussmann et al.
5,638,615 A 6/1997 Korsen
5,836,092 A * 11/1998 Yarnell ..... 36/61
5,848,482 A 12/1998 Bathum
5,960,568 A 10/1999 Bell et al.
6,108,944 A * 8/2000 Savoie ..... 36/134
6,154,984 A 12/2000 Adam

* cited by examiner

ARTICLE OF FOOTWEAR WITH A GROUND-ENGAGING MEMBER AND METHOD OF ALTERING A GROUND-ENGAGING MEMBER

FIELD OF THE INVENTION

The present invention relates to an article of footwear having one or more ground-engaging members, especially an athletic shoe having one or more selectively alterable ground-engaging members (such as spikes, cleats, etc.). More particularly, the present invention relates to ground-engaging members having a variable height.

BACKGROUND OF THE INVENTION

It is generally known to provide one or more ground-engaging members protruding from the sole of a shoe, especially an athletic shoe for activities such as golf, soccer, track, baseball, and "American-style" football. Such ground-engaging members are variously known in the art as cleats, spikes, studs, leaves, blades, triangles, nubs, etc., and generally serve to increase traction between the shoe and the ground surface.

Furthermore, it is conventionally known to use particular types of ground-engaging members for certain types of playing surfaces. Most generally, the selection of a particular ground-engaging member requires balancing traction-increasing characteristics of the ground-engaging members versus other playing factors. For example, a player who needs to quickly or suddenly turn while running must be able to quickly pick up his or her feet from the playing surface. Otherwise, if the player "plants" a foot, his or her ankle or knee may be injuriously twisted when attempting to change direction suddenly. Therefore, the ground-engaging members used in this case should not increase traction too much in order to avoid injury. On the other hand, a player whose movement involves mostly running in one direction can benefit from a relatively greater increase in traction.

Thus, for example, molded cleats made from hard rubber or a thermoplastic material are commonly used on hard/firm natural ground surfaces (e.g., hard dirt). Relatively smaller molded rubber nubs are commonly used on artificial turf and the like. Also, relatively thin spikes are conventionally used in golf and in track.

For activities taking place on soft ground (e.g., wet fields, soggy grass, or muddy ground), it is generally known to use removable ground-engaging members. This is done to enable the user to use ground-engaging members having different sizes based on the type of field being played on, and the condition of the field. Conventional removable ground-engaging members are typically engaged with a shoe sole by way of cooperating screw threads or other rotational engagement.

Changing conventional removable ground-engaging members is generally time-consuming and labor intensive, because a collection of individual ground-engaging members must be carried, and changing each ground-engaging member requires removing one ground-engaging member from a shoe in addition to mounting a new ground-engaging member. Furthermore, individual ground-engaging members may be dropped inadvertently, and, as a result, may be lost, particularly when changing ground-engaging members in a hurried manner.

Furthermore, conventional removable ground-engaging members must be adequately rotationally tightened so as to ensure good engagement between the shoe and the ground-engaging member. However, it is conventionally difficult to recognize when the ground-engaging member has been adequately tightened. Thus, the ground-engaging member may be inadvertently over-torqued in an attempt to ensure good engagement. This can damage the screw threads on the shoe and/or on the ground-engaging member, making it difficult or even impossible to subsequently disengage the ground-engaging member from the shoe when desired. On the other hand, the ground-engaging member may be inadvertently under-torqued (for example, to avoid damage caused by over-torquing). When this occurs, the ground-engaging member may not function as a stable traction device and/or may become loose and be susceptible to falling off of the shoe.

In view of the foregoing, it is desirable to provide the ground-engaging functionality of conventional ground-engaging members as discussed above, while avoiding problems associated with using individual elements that are selectively attached to a shoe sole.

SUMMARY OF THE INVENTION

The present invention is therefore generally directed to an article of footwear (such as a shoe, and especially, but not necessarily only, an athletic shoe like a cleated soccer shoe) having a selectively alterable ground-engaging member provided on a sole, and a method for altering ground-engaging characteristics of an article of footwear.

A ground-engaging member according to the present invention is preferably provided as a single unit engaged with or otherwise attached to the sole. The ground engaging member has a portion extending outwardly from the sole that is positionable at one a plurality of positions relative to the sole. For example, the ground-engaging member may include a base engaged with the sole and a tip that is selectively extendable and retractable in a telescopic manner (to a limited extent) relative to the base so as to present a selectively variable height (i.e., a distance that the ground-engaging member extends from the sole). The tip may be extended or retracted relative to the base by any suitable method, including (for example and without limitation) manually or with an appropriately shaped tool.

The ground-engaging member according to the present invention may further include a tip locking mechanism for selectively holding the tip in one or more particular positions relative to the base. Thus, for example, the tip can be telescopically moved relative to the base and selectively locked into a given position relative to the base.

In one example of the present invention, the tip may be threadedly mounted with respect to the base such that the tip can be selectively extended or retracted with respect to the base by appropriately rotating the tip relative to the base. The tip can be rotated, for example and without limitation, manually or an appropriately shaped tool, such as a tool shaped to engage a distal end portion of the tip.

In one example of the present invention, therefore, a cleated article of footwear has a plurality of cleats, each cleat including a telescoping ground-engaging portion adjustably positionable relative to the remainder of the cleat at one of a plurality of heights.

When a tip is adjusted with respect to the base according to the present invention, it is desirable to provide a detectable feedback to indicate that the tip is properly engaged in a given position. In a particular (but not exclusive) example of the present invention, the detectable feedback is an audible feedback (such as, without limitation, a snapping sound or a click sound) that a user can hear when the tip is properly located in a predetermined position relative to the base.

BRIEF DESCRIPTION OF THE DRAWINGS

The present invention will be described in detail hereinbelow with reference to the attached drawings, in which.

DETAILED DESCRIPTION OF THE PRESENT INVENTION

Figure 1:
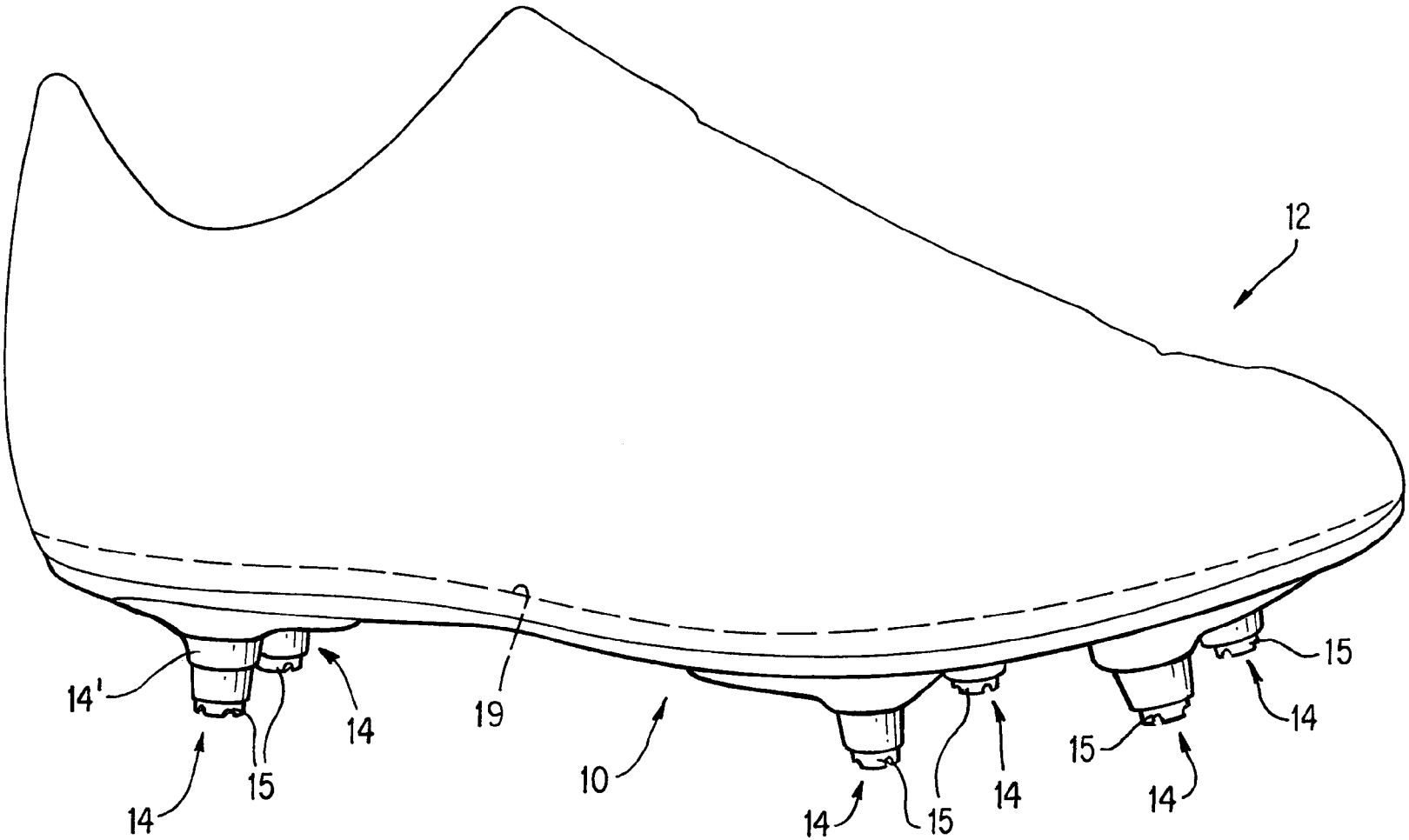
FIG. 1 is a side elevational view of an article of footwear provided with a plurality of ground-engaging units according to the present invention.

FIG. 1 is a lateral (i.e., from the laterally outer side) elevational view of an article of footwear. The article of footwear, such as an athletic shoe 12, is preferably cleated and may be provided with a footplate 10. A right shoe happens to be illustrated by way of example, but this should not be taken as limiting the present invention. Only an outline of the shoe upper is shown in FIG. 1 because the details thereof are not germane to the present invention.

For the purposes of the description herein, shoe 12 has a "sole" which includes footplate 10. However, other parts that may be included in a sole, such as a midsole, etc. have been omitted from the drawings for clarity. In use, a user rests his foot on a footbed 19 inside the shoe 12.

Figure 2:
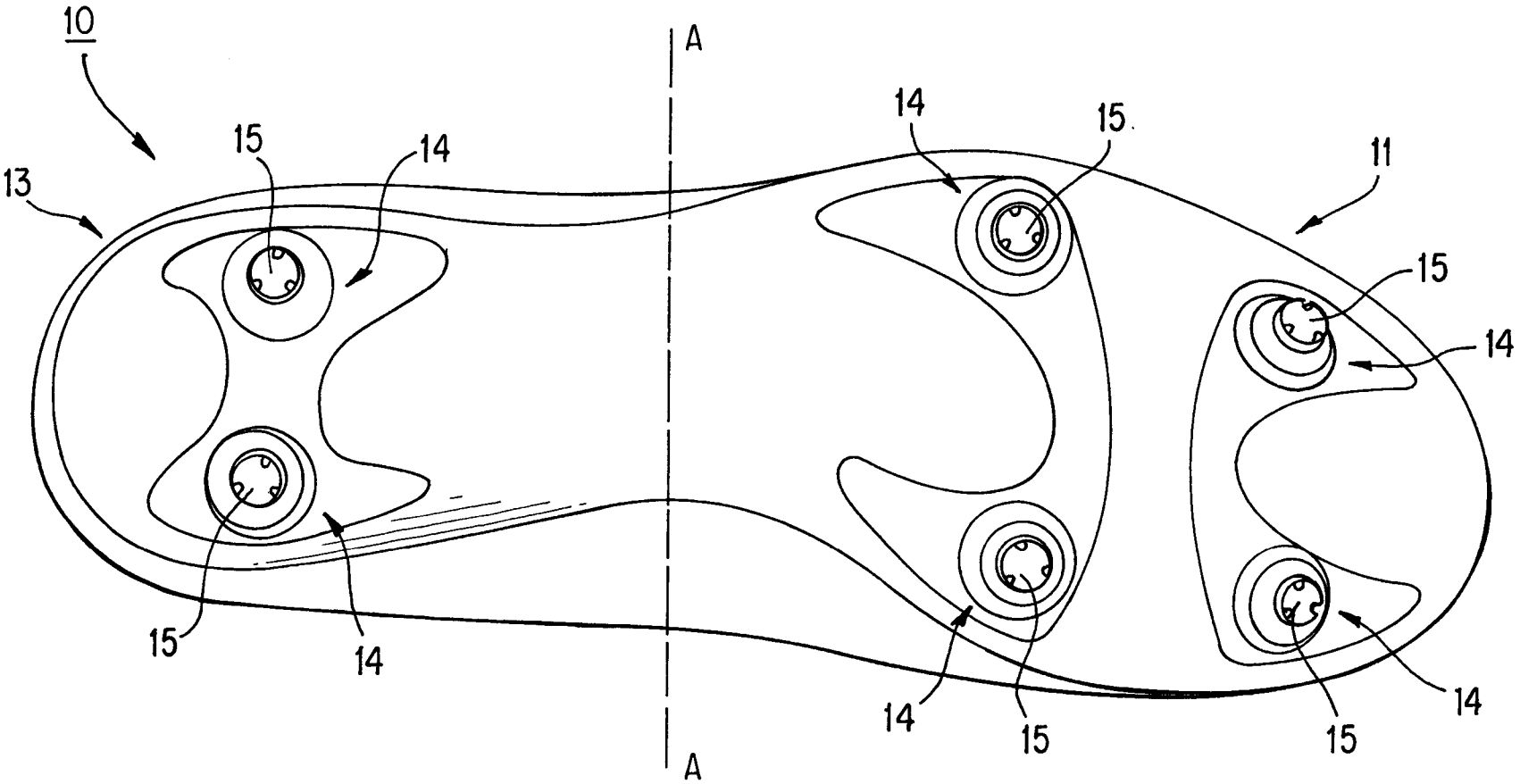
FIG. 2 is a bottom plan view of the article of footwear illustrated in FIG. 1.

Footplate 10 includes at least one ground-engaging unit 14 (such as a cleat) extending from footplate 10. Commonly, footplate 10 includes a plurality of ground-engaging units 14 distributed over the surface of footplate 10. FIG. 2 illustrates one example of how ground-engaging units 14 may be distributed over the surface of footplate 10.

Generally, the article of footwear can be divided into a forefoot region 11 (generally to the right of line A—A in FIG. 2) and a heel or rearfoot region 13 (generally to the left of line A—A in FIG. 2). Thus, in some cases, the forefoot region 11 may include a greater number of ground-engaging units 14 than the heel region 13, as illustrated in FIG. 2. However, it is emphasized that the specific number, location, and/or shape of the ground-engaging units 14 that are provided on footplate 10 may vary widely and still be in accordance with the present invention as presently contemplated.

Figure 3:
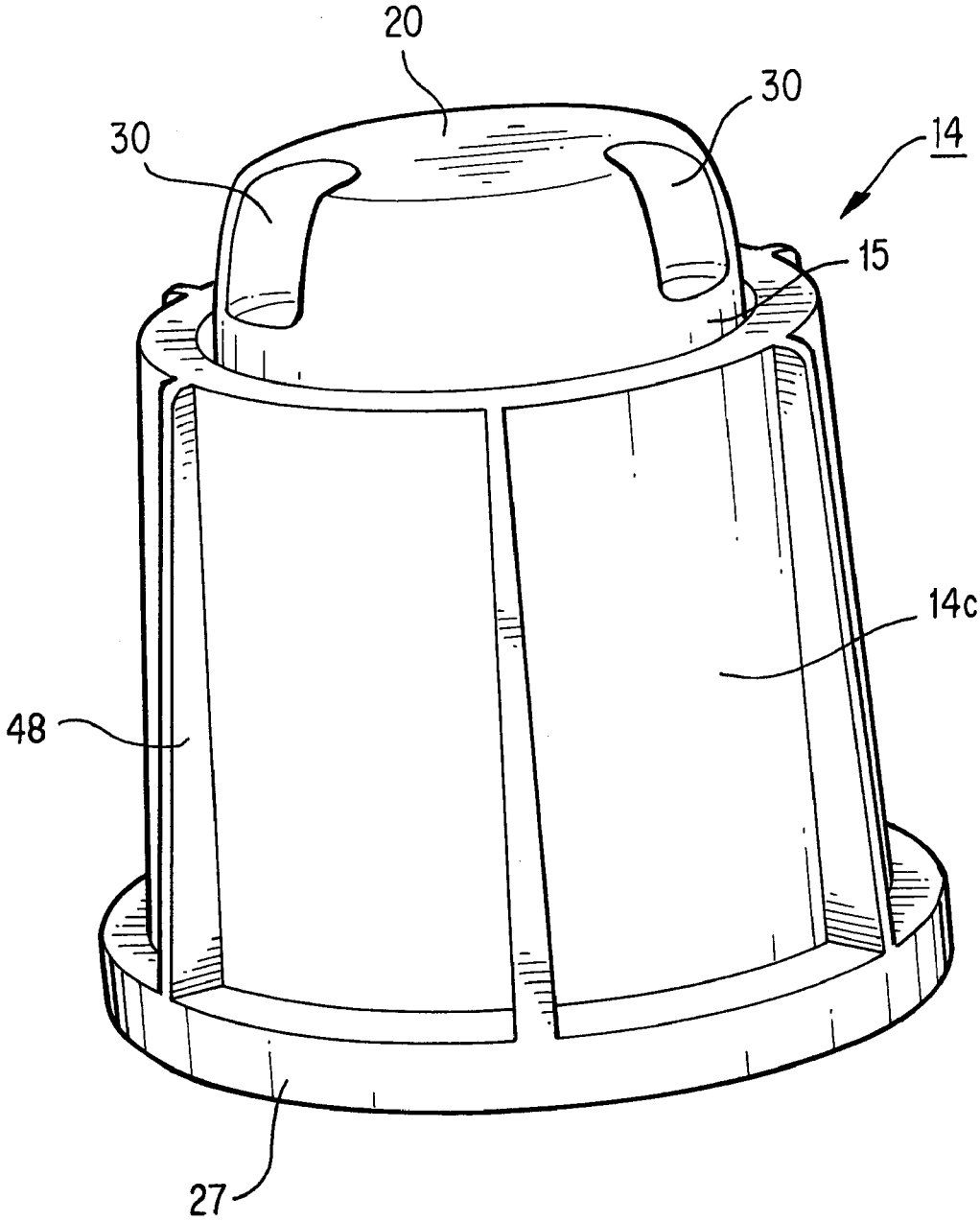
FIG. 3 is a perspective view of a ground-engaging unit according to the present invention.

Each ground-engaging unit 14 according to the present invention may include, in part, a tip 15 (see, for example, FIGS. 3 and 4) adjustably mounted relative to a base 44. Base 44 is preferably fixedly attached to the sole. Generally, tip 15 is telescopically coupled to base 44 so that an extent to which tip 15 extends from base 44 can be varied. In a particular example of the present invention, tip 15 is rotatably coupled in a telescopic manner to base 44. In one example, tip 15 may adopt one of a plurality of fixed positions relative to base 44, whereby tip 15 can be retained in a desired position. Preferably, tip 15 is selectively locked in a given position, so that tip 15 does not move under normal use. For example, the traction performance of shoe 12 can be adjusted by varying the position of tip 15.

In one arrangement of the present invention, base 44 includes a stem 44*a* and a wall member 44*b*. For example, stem 44*a* includes a shaft 16*a* extending from a base plate 16*b*. Tip 15 has a bore 18 (see, for example, FIG. 5) formed therein for receiving shaft 16*a*. Generally, tip 15 is telescopically movable along shaft 16*a* so as to be selectively extendable or retractable relative to stem 44*a* to raise or lower tip 15 relative to the footbed 19 and the footplate 10 of shoe 12. The relatively large area presented by base plate 16*b* and base 27 which is part of the wall member 44*b*, as compared to the area of the end of shaft 16*a*, helps to increase the weight-bearing characteristics of ground-engaging unit 14 by spreading the load borne by tip 15 and transmitted to shaft 16*a* over the comparatively wider area of base plate 16*b*.

It is desirable to provide a locking mechanism so that tip 15 can be maintained in a desired position relative to base 44 during athletic use. Any desired locking mechanism may be used in accordance with the present invention. In one specific example of a locking mechanism, tip 15 includes a ground-contacting head portion 20 at one end and a shielded portion (shielded by wall member 44*b*) including at least one spring member 22 having an outwardly extending protrusion 24 provided at least adjacent to a free end of spring member 22. Three spring members 22 are illustrated by way of example. Spring members 22 may, for example, extend in a circumferential direction about, an exterior periphery of tip 15 (see, especially, FIG. 5) although other arrangements are operable in accordance with the present invention. For example, one or more radially extensible locking members may be provided that are radially outwardly biased (not shown).

In addition, wall member 44*b* surrounds stem 44*a* so as to define an annular space between stem 44*a* and wall member 44*b* in which a peripheral portion of tip 15 passes. However, protrusions 24 protrude radially outward beyond the outer peripheral surface of tip 15. Thus, in order to accommodate protrusions 24 in the annular space between shaft 16*a* and wall member 44*b*, the corresponding spring members 22 are resiliently compressed inward. One or more recesses 26 are preferably provided in the interior surface of wall member 44*b* corresponding to protrusions 24. When the protrusion and recess are aligned, then protrusions 24 will resiliently snap into engagement with a respective recess 26. This maintains tip 15 in a desired position relative to stem 44*a*.

It will be appreciated, then, that a plurality of recesses 26*a*, 26*b*, 26*c* can be provided, each corresponding to a respective desired position of tip 15 relative to stem 44*a*. This is explained in further detail below.

Figure 4:
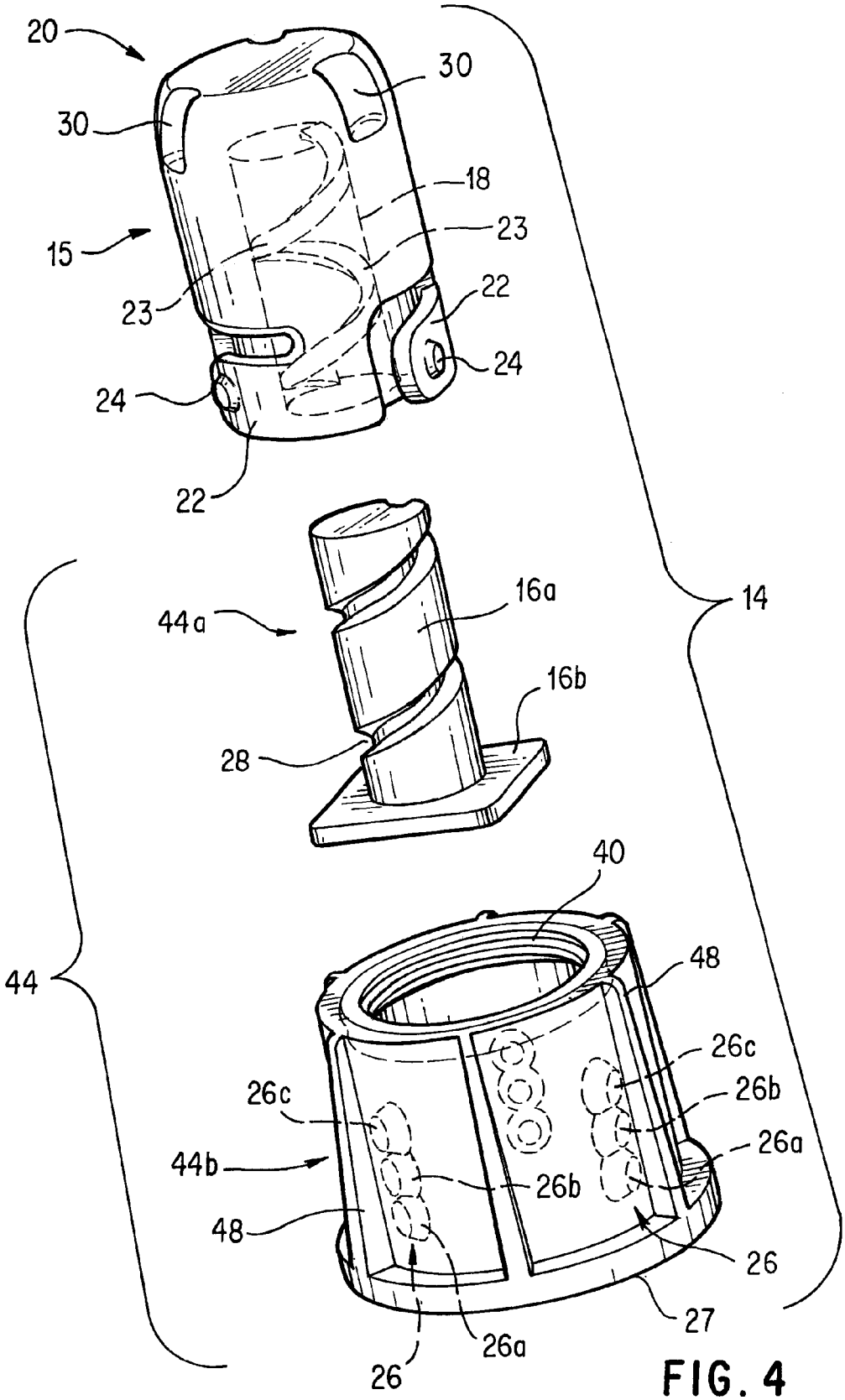
FIG. 4 is an exploded perspective view illustrating constituent parts of one example of a ground-engaging unit according to the present invention.
Figure 5:
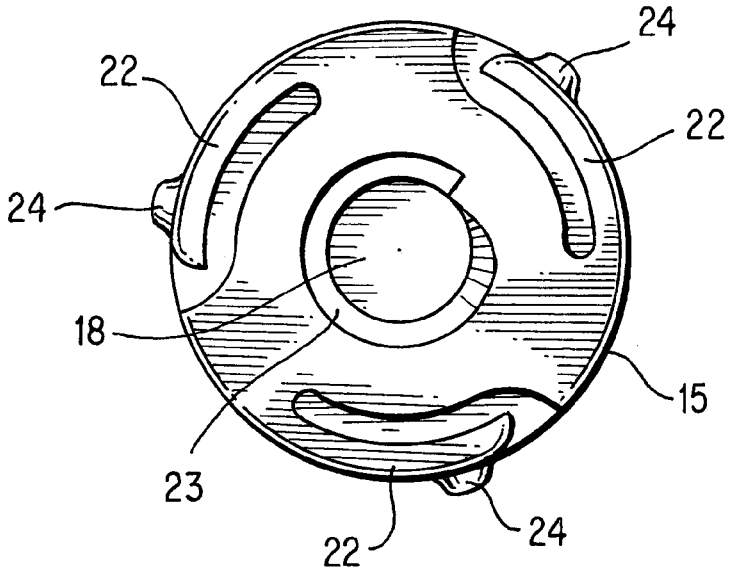
FIG. 5 is a bottom view of an example of a tip according to the present invention.

In order to further increase the axial load bearing characteristics of ground-engaging unit 14, it may be desirable to threadedly engage tip 15 with stem 44*a* by providing a first thread 23 on an interior of bore 18 and a corresponding second thread 28 on the exterior of shaft 16*a*, as illustrated in, for example, FIGS. 4 and 5. By providing such a threaded relationship, the height of tip 15 can be varied by rotating tip 15 about shaft 16*a*.

Tip 15 can be selectively locked in a desired position relative to shaft 16*a* in a manner similar to that described above—namely, providing recesses 26 on the interior surface of wall member 44*b* in locations corresponding to desired axial positions of tip 15. It will be appreciated that the thread pitch can be varied and/or the position of the recesses 26 on the interior surface of wall member 44*b* can be varied so that tip 15 can assume a plurality of axial positions. In a particular example, tip 15 can assume a plurality of distinct axial positions. For example, the axial position of tip 15 may be varied in 2.0 mm increments. Therefore, ground-engaging unit 14 may have an effective height between, for example, about 12 mm to about 16 mm, in about 2.0 mm steps.

As seen in FIGS. 4 and 5, a plurality of spring members 22 may be provided, each including a respective protrusion 24. In one example, as seen in FIG. 5, the respective protrusions 24 are spaced about an exterior periphery of tip 15 at about 120 degree intervals. In general, the protrusions are preferably (but not necessarily) regularly spaced about the periphery of tip 15.

With the use of multiple spring members 22 as seen in FIGS. 4 and 5, pluralities of recesses 26 may be provided in sets located about the interior periphery of wall member 44*b*. For example, three groups of angularly-spaced recesses are located on the interior wall of wall member 44*b* as seen in phantom in FIG. 4. Preferably, the groups are equidistantly-spaced. Accordingly, since three groups of recesses are provided in this embodiment, the groups of recesses are preferably spaced 120 degrees apart about the interior periphery of wall member 44*b*. The number of vertically-spaced recesses within each group of recesses correspond to the number of fixed positions of the tip 15 relative to the base 44. The provision of three groups of recesses and the provision of three recesses in each group of recesses in this example is strictly for the purpose of illustrating the present invention. It is expressly emphasized that both parameters can be varied according to the present invention as may be needed.

As seen in phantom in FIG. 4, recesses 26*a*, 26*b*, 26*c* extend along a longitudinal direction of wall member 44*b*. In one example of the present invention, respective recesses or respective groups of recesses are coplanar in a substantially horizontal plane (i.e., the three of the bottom recesses 26*a* are coplanar with each other, the three of the intermediate recesses 26*b* are coplanar with each other, and the three of the top recesses 26*c* are coplanar with each other). Each "layer" of recesses corresponds to a given distinct position of tip 15 with respect to base 44. Thus, as tip 15 is rotated, protrusions 24 are rotatably forced into and out of engagement of the recesses in the different coplanar "layers." For example, the lower recesses 26*a* correspond to a ground-engaging unit height of 12 mm, the row of intermediate recesses 26*b* correspond to a height of 14 mm, and the row of top recesses 26*c* correspond to a height of 16 mm. Therefore, if a protrusion 24 is initially engaged with a recess 26*a*, then rotating the tip 15 120 degrees counter-clockwise will place that protrusion 24 in engagement with a recess 26*b* in the set of recesses spaced 120 degrees apart from the first set of recesses and tip 15 will rise above base 44 by, for example, 2 additional millimeters. While the illustrated embodiment shown three protrusions and three sets of recesses, it is recognized that the number of recesses or protrusions can be greater or less than those in the illustrated and described arrangement.

The engagement between protrusions 24 and recesses 26 lock tip 15 into a given position relative to base 44. This locking force can be overcome by exerting a suitable amount of rotational force to tip 15.

Tip 15, stem 44*a*, and wall member 44*b* may be made from any material exhibiting sufficient resistance to material fatigue. In one example of the present invention, the aforementioned elements of ground-engaging unit 14 may be made from molded glass-filled nylon 12 or polyethermide. Alternatively, at least tip 15 may be formed from metal. In one variation of the present invention, stem 44*a* and wall member 44*b* may be unitarily formed.

Generally, base 44 is molded into footplate 10. For example, the material constituting footplate 10 may be overmolded at least adjacent to a distal edge of wall member 44*b*. In this regard, an exterior surface of wall member 44*b* may optionally be provided with ribs or splines 48 to provide an increased bonding area, keep the cross-sectional shape substantially circular during molding, and/or prevent base 44 from rotating within a raised portion 14' of footplate 10 during play and/or adjustment. In one example of the present invention, the material constituting the footplate 10 may be molded over the exterior surface of wall member 44*b* to form raised portions 14' extending outwardly from the surface of footplate 10, whereby substantially only a portion of tip 15 protrudes outwardly therefrom.

Tip 15 may be rotated by any desirable method. In one example of the present invention, it may be desirable to use a tool to rotate tip 15 (especially considering the force needed to overcome the locking force provided by spring members 22). In particular, a tool may provide better force transfer in rotating tip 15. Therefore, the head portion 20 of tip 15 may be provided with one or more notches 30 (or other engagement points) for cooperating with a tool for rotating tip 15. Notches 30 may be provided on the head portion 20 (as seen, for example, in FIG. 4). Alternative examples include, without limitation, longitudinally extending notches along the periphery of tip 15 (not shown).

It is noted that providing notches in the head portion 20 of tip 15 may, in effect, present a more pointed ground contact area which can make it easier for tip 15 to penetrate the ground.

Figure 6:
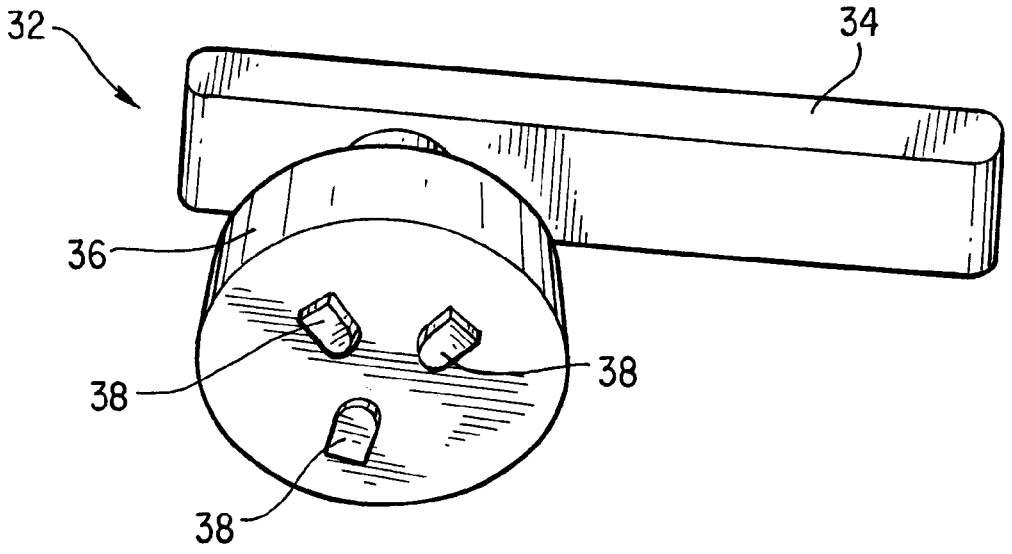
FIG. 6 is a perspective view of an example of a tool for rotating a tip of the ground-engaging unit according to the present invention.

An example of a tool for use with the present invention is illustrated in FIG. 6. Tool 32 includes a manually grippable handle or the like 34 and a head portion 36 attached to handle 34. Head portion 36 includes protrusions or nubs 38 arranged and/or shaped to engage with notches 30 provided in head portion 20.

Tip 15 may be either axially symmetrical (e.g., conical, frusto-conical, pyramidal, substantially cylindrical, etc.) or may be uniquely shaped for a given activity or sport.

A sealing member, such as an O-ring 40 is preferably provided in the annular space between wall member 44*b* and shaft 16*a*, for example, at or adjacent to a distal edge of wall member 44*b*. Most preferably, a radially inner portion of O-ring 40 contacts the peripheral surface of tip 15. O-ring 40 prevents dirt and debris from lodging or caking in the annular space between wall member 44*b* and shaft 16*a*. In addition, as tip 15 is rotated upwardly and downwardly from base 44, O-ring 40 provides a wiping action against the peripheral surface of tip 15 to help keep tip 15 clean. Also, O-ring 40 may provide frictional contact resistance that helps to retard undesirable rotation of tip 15. O-ring 40 may be made of any known, soft and resiliently pliable material, such as, without limitation, soft plastic or rubber.

As mentioned above, ground-engaging unit 14 may be provided in a thickened or raised portion 14' of footplate 10. Using a plurality of base portions 14' in this manner permits the rest of footplate 10 to remain relative thin, and importantly, flexible. In contrast, when raised base portions 14' are not provided, the entire sole (including footplate 10) must be made comparatively thicker overall in order to accommodate the ground-engaging units 14 therein.

It is a feature of the present invention to adjust respective ground-engaging units 14 to differing heights. Thus, the ground engaging characteristics of the article of footwear can be altered by providing a given arrangement of ground-engaging units 14 of varying (or identical) heights. This permits even greater control over the ground engaging characteristics of the article of footwear.

Therefore, according to the present invention, the ground-engaging characteristics of a shoe can be selectively altered by adjusting the respective heights of ground-engaging units 14 provided on the sole of a shoe. The heights (i.e., the heights of the respective tips 15 above the sole) of the ground-engaging units 14 can be all changed to the same height. Also, the heights of the ground-engaging units 14 can be all changed to different respective heights. Finally, some heights can be made the same while others are set to different heights. To change the height of a given ground-engaging unit 14, tip 15 is, for example, rotated so as to change its height relative to the remainder of the shoe sole. This rotation can be accomplished by a manual technique or by using a tool (like that illustrated in FIG. 6, for example) to engage and rotate tip 15. If, for example, tool 32 is used, a user grips tool 32 by handle 34 and positions tool 32 so that protrusions 38 on the tool head 36 engage notches 30 on tip 15. Thereafter, a torque is applied that is sufficient to overcome the engagement between spring-biased protrusions 24 and recesses 26. Because of the position of recesses 26 on the interior surface of wall member 44*b* and/or the thread pitch of the threaded engagement between tip 15 and shaft 16*a*, the telescopic position of tip 15 can be adjusted as desired so that the protrusions 24 engage another set of the recesses 26 corresponding to a desired telescopic position of tip 15. For example, it may be desirable to raise tip 15 so as to increase the traction effects provided. Because the present invention does not use a physically separate part (such as a conventionally detachable stud or spike), the process of adjusting ground-engaging characteristics of a shoe is simplified. In particular, the present invention avoids the use of a plurality of physically separate elements that have to be individually sorted and mated to a shoe and that can be inadvertently dropped or even lost.

Thus, while there have been shown and described and pointed out fundamental novel features of the present invention as applied to preferred embodiments thereof, it will be understood that various omissions and substitutions and changes in the form and details of the devices illustrated, and in their operation, and in the method illustrated and described, may be made by those skilled in the art without departing from the spirit of the invention as broadly disclosed herein.

What is claimed is:

1. An article of footwear comprising a sole, said sole including:

a ground engaging member extending from said sole, said ground engaging member having a base attached to the sole and a moveble portion being telescopingly positionable at one of a plurality of predetermined positions relative to said base, said base being concentrically disposed about a stem, and said movable portion includes a spring member extending in circumferential direction relative to said movable portion and being resiliently biased in a radially outward direction, said base having a plurality of first locking portions formed therein and a distal end of said spring member having a second locking portion formed on an outward side thereof, wherein said movable portion is configured so that said second locking portion selectively engages one of said first locking portions so as to lock said movable portion in positional relationship with said base at said one of a plurality of predetermined positions.

2. The article according to claim 1, wherein said spring members are leaf springs formed with said movable portion.

3. The article according to claim 2, further comprising a seal disposed on the base configured for sealing engagement with said movable portion.

4. The article according to claim 2, wherein said first locking portions are recesses and said second locking portion is a protrusion.

5. An article of footwear comprising a sole, said sole including:

a ground engaging member extending from said sole, said ground engaging member having a portion being positionable at one of a plurality of predetermined positions relative to said sole; wherein said ground engaging member comprises:

a base attached to said sole; and wherein said portion includes a tip movably coupled to said base and being selectively extendable and retractable relative to said base;

wherein said base comprises a stem and said tip includes a bore formed therein in which said stem is received, such that said tip is movable along said stem;

wherein said base includes a wall member formed concentrically about said stem and said tip includes a leaf spring member extending in a circumferential direction relative to said tip and being resiliently biased in a radially outward direction, wherein an interior surface of said wall member has a plurality of depressions formed therein and a distal end of said leaf spring member has a protrusion formed on an outward side thereof, wherein said tip is movable a along said stem such that said protrusion selectively engages one of said depressions so as to fix said tip in positional relationship with said base.

6. The article according to claim 5, wherein said stem has a first threading formed thereon and an interior wall of said bore has a second threading cooperating with said first threading formed thereon.

7. The article according to claim 5, wherein said base is disposed within said sole.

8. The article according to claim 5, wherein said base is disposed within a portion of said sole.

9. The article according to claim 8, wherein said sole includes a footplate and said footplate is made from a molded material, said base being overmolded within a portion of said footplate.

10. An article of footwear comprising a sole, said sole including:

a ground engaging member extending from said sole, said ground engaging member having a portion being positionable at one of a plurality of predetermined positions relative to said sole; wherein said ground engaging member comprises:

a base attached to said sole; and wherein said portion includes a tip movably coupled to said base and being selectively extendable and retractable relative to said base;

wherein said base comprises stem and said tip includes a bore formed therein in which said stem is received, such that said tip is movable along said stem;

wherein said stem has a first threading formed thereon and an interior wall of said bore has a second threading cooperating with said first threading formed thereon;

a tip locking mechanism for locking said tip relative to said base, said tip locking mechanism being constructed and arranged to lock said tip relative to said base at a plurality of distinct position; wherein said base includes a wall member formed concentrically about said stem and said tip includes a leaf spring member extending in a circumferential direction relative to said tip and being resiliently biased in a radially outward direction, wherein interior surface of said wall member has a plurality of depressions formed therein an a distal end of said leaf spring member has a protrusion formed on an outward side thereof, wherein said tip is movable along said stem such that said protrusion selectively engages one of said depressions so as to fix said tip in a positional relationship with said base.

11. The article according to claim 10, wherein a distal portion of said tip is shaped to cooperate with a tool for rotating said tip.

12. The article according to claim 10, wherein a pitch of said cooperating first and second threadings is such that one said distinct position of said tip is spaced about 2 mm from a next said distinct position of said tip.

13. The article according to claim 10, wherein said plurality of depressions are circumferentially spaced about an interior of said wall member at about 120 degrees apart.

14. The article according to claim 10, wherein said tip includes three said leaf spring members extending in a circumferential direction relative to said tip and being resiliently biased in a radially outward direction, each said leaf spring member having a protrusion, said protrusions being circumferentially spaced apart by about 120 degrees.

15. The article according to claim 14, wherein said plurality of depressions comprises a plurality of sets of 3 depressions, each set of 3 depressions corresponding to a respective said distinct position of said tip such that said protrusions selectively engage a respective set of depressions.

16. A method of adjusting a ground-engaging member of a shoe, the ground-engaging member including a tip telescopically coupled to a base and said tip having a plurality of peripheral spring elements biased towards an interior surface of said base and the base having a plurality of corresponding receiving elements to said spring elements, said method comprising:

telescopically moving the tip relative to the base;

responsive to said moving, said spring elements abutting said interior surface of said base; and selectively locking the tip with the spring members in place relative to the base in said receiving elements at on of a plurality of different heights.

17. The method according to claim 16, wherein the telescopically moving step comprises rotating the tip relative to the base.

18. The method according to claim 17, wherein the rotating the tip step includes changing the height of the tip relative to the base by about 2 mm.

19. A cleated article of footwear comprising:

a plurality of cleats, each said cleat including a telescoping ground-engaging portion adjustably positionable within the remainder of its respective cleat between a plurality of different heights, said telescoping ground-engaging member includes a plurality of circumferentially extending spring biased members with a protrusion portion configured to lockingly engage with said remainder of said cleat to maintain said telescoping ground-engaging portion in a locked position at a given selected height of said plurality of different heights.

20. The article of footwear according to claim 19, wherein said remainder of said cleat includes a resilient sealing element configured to circumferentially abut a peripheral surface of said telescoping ground-engaging portion.

21. The article of footwear according to claim 19, wherein said telescoping ground-engaging portion includes a distal tip provided with at least one recess shaped and arranged to receive a torque-applying tool.

22. The article of footwear according to claim 19, wherein said remainder of said cleat includes a plurality of receiving portions configured to lockingly receive therein the protrusion portion of said spring biased members.

23. The article of footwear according to claim 19, wherein said remainder of said cleat includes a resilient annular sealing element configured for sealing engagement with a peripheral surface of said telescoping ground-engaging portion.

24. The article of footwear according to claim 19, further comprising a footplate on which said plurality of cleats are provided, each said cleat comprising a base portion, a material from which said footplate is made being overmolded over at least a portion of an outer side of said base portion.

25. The article of footwear according to claim 24, wherein said outer side of said base portion includes at least one longitudinally extending rib formed thereon.

26. A kit including the article of footwear according to claim 19 and a tool constructed and arranged to engage said telescoping ground-engaging portion.

27. The kit according to claim 26, wherein said telescoping ground-engaging portion includes a tip provided with at least one recess formed therein, said tool including a corresponding at least one protrusion shaped and arranged to engage said at least one recess formed in said tip.

28. The kit according to claim 26, wherein said telescoping ground-engaging portion includes a tip provided with at least one recess formed thereon, said tool including a corresponding at least one protrusion and arranged to engage said at least one recess formed in said tip.

29. An article of footwear, comprising:

an upper; and a sole including a plurality of ground engaging members extending therefrom in which at least one of the ground engaging members includes a base having an interior surface and the base being attached to the sole, the at least one of the ground engaging members including a telescoping portion being received within the base, the telescoping portion being configured for linear movement at a plurality of predetermined heights responsive to rotational movement about an axis, the telescoping portion having a plurality of locking members being radially biased towards the interior surface of the base, said locking members configured for selective locking engagement with the base at said plurality of predetermined heights.

* * * * *

UNITED STATES PATENT AND TRADEMARK OFFICE

CERTIFICATE OF CORRECTION

PATENT NO. : 6,647,647 B2
DATED : November 18, 2003
INVENTOR(S) : Perry Auger et al.

It is certified that error appears in the above-identified patent and that said Letters Patent is hereby corrected as shown below:

Title page,
Item [56], References Cited, OTHER PUBLICATIONS, please insert:
-- Champ, Sport Cleats & Spikes, 4 sheet, (date unknown, but prior to the filing of this application) --.

Column 8,
Lines 36-37, please replace "...is movable a along said..." with
-- is a movable along said --.

Signed and Sealed this

Eleventh Day of May, 2004

JON W. DUDAS
*Acting Director of the United States Patent and Trademark Office*